US006938647B2

(12) United States Patent
Pages et al.

(10) Patent No.: US 6,938,647 B2
(45) Date of Patent: Sep. 6, 2005

(54) ROTATING DOBBY FOR WEAVING LOOM AND WEAVING LOOM EQUIPPED WITH SUCH A DOBBY

(75) Inventors: Jean-Pierre Pages, Faverges (FR); Patrick Iltis, Saint Jorioz (FR)

(73) Assignee: Staubli Faverges, Faverges (FR)

( * ) Notice: Subject to any disclaimer, the term of this patent is extended or adjusted under 35 U.S.C. 154(b) by 235 days.

(21) Appl. No.: 10/615,848

(22) Filed: Jul. 10, 2003

(65) Prior Publication Data

US 2004/0011417 A1 Jan. 22, 2004

(30) Foreign Application Priority Data

Jul. 16, 2002 (FR) ..... 02 08972

(51) Int. Cl.[7] ..... D03C 1/00
(52) U.S. Cl. ..... 139/66 R; 139/76; 74/567
(58) Field of Search ..... 139/66 R, 76, 139/68; 74/567

(56) References Cited

U.S. PATENT DOCUMENTS

| | | | | | |
|---|---|---|---|---|---|
| 3,828,824 | A | * | 8/1974 | Macho | 139/1 E |
| 4,497,346 | A | | 2/1985 | Hintsch et al. | |
| 4,544,000 | A | | 10/1985 | Borugeaux | |
| 4,832,087 | A | * | 5/1989 | Palau et al. | 139/71 |
| 5,209,270 | A | * | 5/1993 | Vinciguerra | 139/76 |
| 5,341,850 | A | * | 8/1994 | Froment et al. | 139/79 |
| 5,365,979 | A | * | 11/1994 | Yoshida | 139/66 R |
| 5,479,964 | A | * | 1/1996 | Burigana | 139/76 |
| 5,908,050 | A | * | 6/1999 | Froment et al. | 139/66 R |
| 5,918,645 | A | * | 7/1999 | Froment et al. | 139/66 R |
| 6,105,630 | A | * | 8/2000 | Braun et al. | 139/455 |
| 6,802,111 | B1 | * | 10/2004 | Dion et al. | 29/281.5 |

FOREIGN PATENT DOCUMENTS

| | | |
|---|---|---|
| DE | 3614218 | 10/1987 |
| FR | 2540524 | 8/1984 |
| FR | 2757882 | 7/1998 |
| FR | 2802218 | 6/2001 |
| JP | 200096379 | 4/2000 |

* cited by examiner

*Primary Examiner*—John J. Calvert
*Assistant Examiner*—Robert H. Muromoto, Jr.
(74) *Attorney, Agent, or Firm*—Dowell & Dowell, P.C.

(57) ABSTRACT

The dobby according to the invention comprises, at the level of each of its blades, an oscillating piece associated with an actuation element, at least one mobile coupling member borne by the actuation element and two pivoting levers subjected, on the one hand, to the action of a reading device and, on the other hand, to that of elastic means which tend to engage catches of the pivoting levers either with a jamming surface provided on the actuation element, or with the coupling member, while the lever in engagement with the jamming surface is out of range of a selector of the reading device. In addition, mechanical members independent of the reading device are adapted to displace, against the action of the elastic means, a lever whose catch is not in engagement with the jamming surface, with the result that it does not interfere with the angular displacement of the selector.

10 Claims, 3 Drawing Sheets

ROTATING DOBBY FOR WEAVING LOOM AND WEAVING LOOM EQUIPPED WITH SUCH A DOBBY

FIELD OF THE INVENTION

The present invention relates to a rotating dobby for controlling the heddle frames mounted on a weaving loom and to a weaving loom equipped with such a dobby.

BACKGROUND OF THE INVENTION

In rotating dobbies, the reciprocating vertical movement of the heddle frames is ensured by connecting rod/oscillating lever assemblies, such oscillating assemblies being controlled by actuation elements in the form of eccentrics. Such actuation elements are mounted on a principal shaft of the dobby which is animated by an intermittent movement of rotation and, whenever this shaft stops, a reading device controls the connection of the actuation element with the shaft in order to control an oscillating piece as a function of the design or weave to be obtained on the fabric being woven.

FR-A-2 540 524 discloses a rotating dobby in which such selective connection is obtained thanks to a plate fast with an eccentric forming actuation element and comprising two diametrally opposite notches adapted to cooperate with the catch of two pivoting levers controlled by a reading device. Furthermore, FR-A-2 757 884 discloses using a pivoting selector intended to selectively actuate one or the other of two pivoting levers of the type mentioned above. This selector is controlled thanks to an electromagnet and subjected to the action of return means. As for FR-A-2 757 882, it teaches providing that, when the pivoting levers are in mesh with certain jamming surfaces provided on a plate, they are out of range of a selector.

In the known devices, particularly those known from FR-A-2 757 882 and FR-A-2 757 884, the mobile assembly forming selector or actuator comprises a pusher which is used for displacing one or the other of the pivoting levers against return efforts to which they are subjected. This pusher must therefore be sufficiently robust to perform this function and the electromagnet which controls it must be powerful, which in practice amounts to increasing its size to such a point that it is not necessarily compatible with the division corresponding to the thickness of the heddle frames of the loom. In addition, the energy necessary for controlling the pusher considerably increases at high speed, which imposes dimensioning this pusher and the electromagnet accordingly. Finally, the electromagnet associated with the pusher is subjected to accelerations and to intense vibrations, which reduces its life duration.

It is a more particular object of the present invention to overcome these drawbacks by proposing a novel arrangement which makes it possible to mechanically stress the pusher of the reading device and the electromagnet associated therewith to a lesser degree, while ensuring a secured functioning of the dobby.

SUMMARY OF THE INVENTION

To that end, the present invention relates to a rotating dobby for weaving loom which comprises, at the level of each of its blades:

an oscillating piece connected to a heddle frame and associated with an actuation element mounted idly on a principal shaft of this dobby, a mobile coupling member borne by the actuation element, this mobile member being subjected to first elastic means in order to effect the angular link of the actuation element with a disc fast with the principal shaft, and the control of said mobile coupling member being ensured with the aid of two pivoting levers substantially in the form of a bracket subjected, on the one hand, to the action of a reading device and, on the other hand, to that of second elastic means which tend to engage the catch provided on each pivoting lever either with a jamming surface provided opposite the mobile coupling member on the actuation element or with the mobile coupling member, in which case the mobile coupling member is controlled for uncoupling of the actuation element with respect to the disc, while, when a lever is in engagement with the jamming surface, it is out of range of a selector belonging to the reading device, this selector being provided with an end adapted alternately to block the pivoting of one or the other of the levers in bracket form, characterized in that this dobby further comprises mechanical members adapted to displace at least one lever, of which the catch is not in engagement with the jamming surface, against the action of the second elastic means, with the result that this lever does not interfere with the angular displacement of the afore-mentioned selector.

Thanks to the invention, the drive of the pivoting levers against the action of the second elastic return means is effected thanks to the mechanical members which are dimensioned taking into account their essentially mechanical function, the selector of the reading device in that case being able to be lighter and controlled by a spring and an electromagnet less powerful than in the devices of the state of the art. The invention makes it possible to push the pivoting levers which are not engaged on a passive jamming surface into a configuration where these levers do not interfere with the coupling member and, in this configuration, to actuate the reading device in order to position the selector opposite one or the other of these levers. In that case the selector has only a role of passive stop when the mechanical members release the pivoting levers. This selector is not subjected to vibrations, which improves its life duration.

According to advantageous but non-obligatory aspects of the invention, this dobby incorporates one or more of the characteristics of claims 2 to 9.

The invention also relates to a weaving loom equipped with a dobby as described hereinbefore. Such a loom is capable of functioning at high speed, without risk of rupture or of premature wear of its reading device, with the result that it is more reliable and more economical than the weaving looms of the state of the art.

BRIEF DESCRIPTION OF THE DRAWINGS

The invention will be more readily understood and other advantages thereof will appear more clearly in the light of the following description of two forms of embodiment of a dobby in accordance with its principle, given solely by way of example and made with reference to the accompanying drawings, in which.

DESCRIPTION OF PREFERRED EMBODIMENTS

Figure 1:
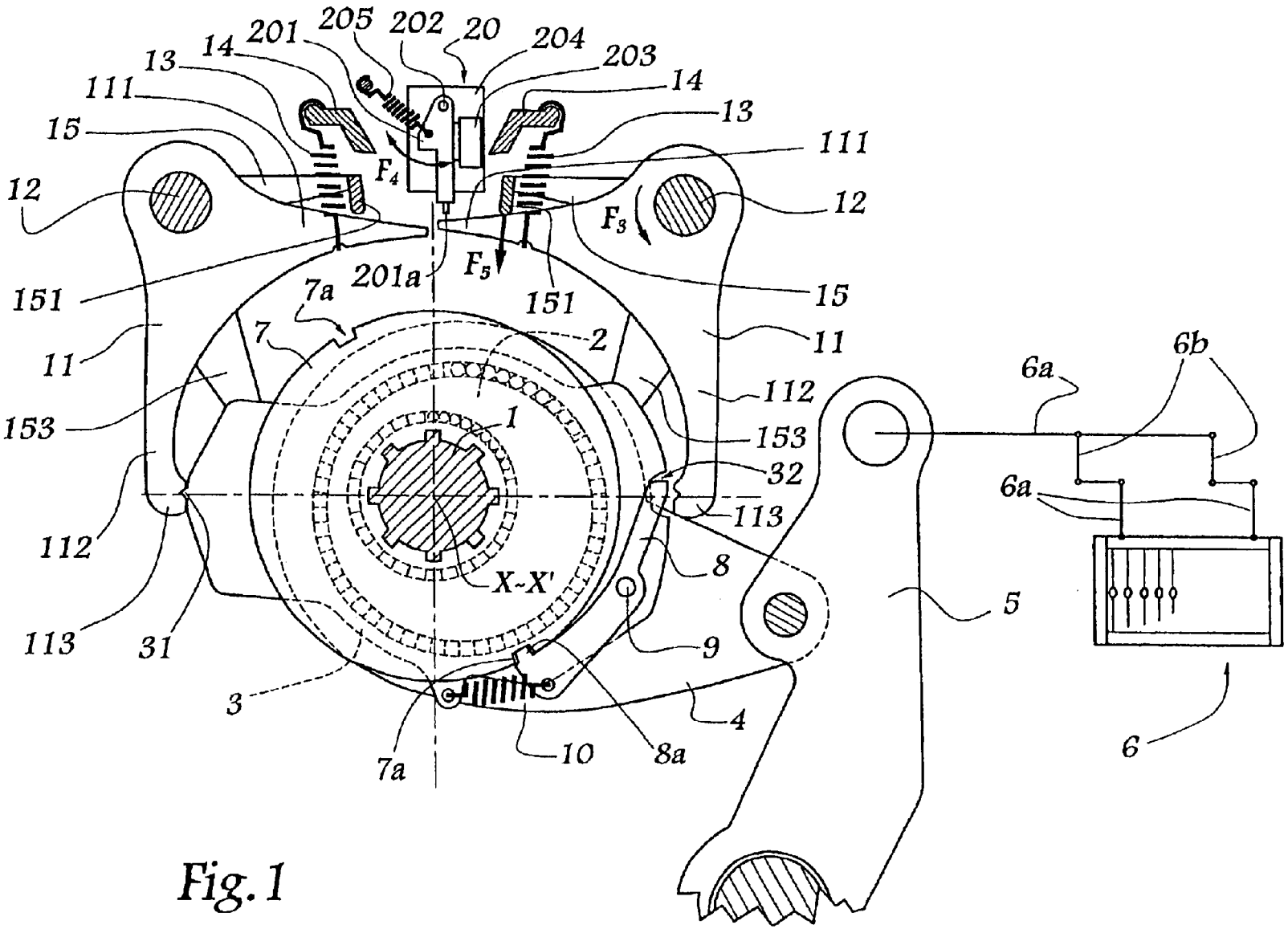
FIG. 1 is a schematic cross section through a dobby in accordance with a first form of embodiment of the invention.
Figure 2:
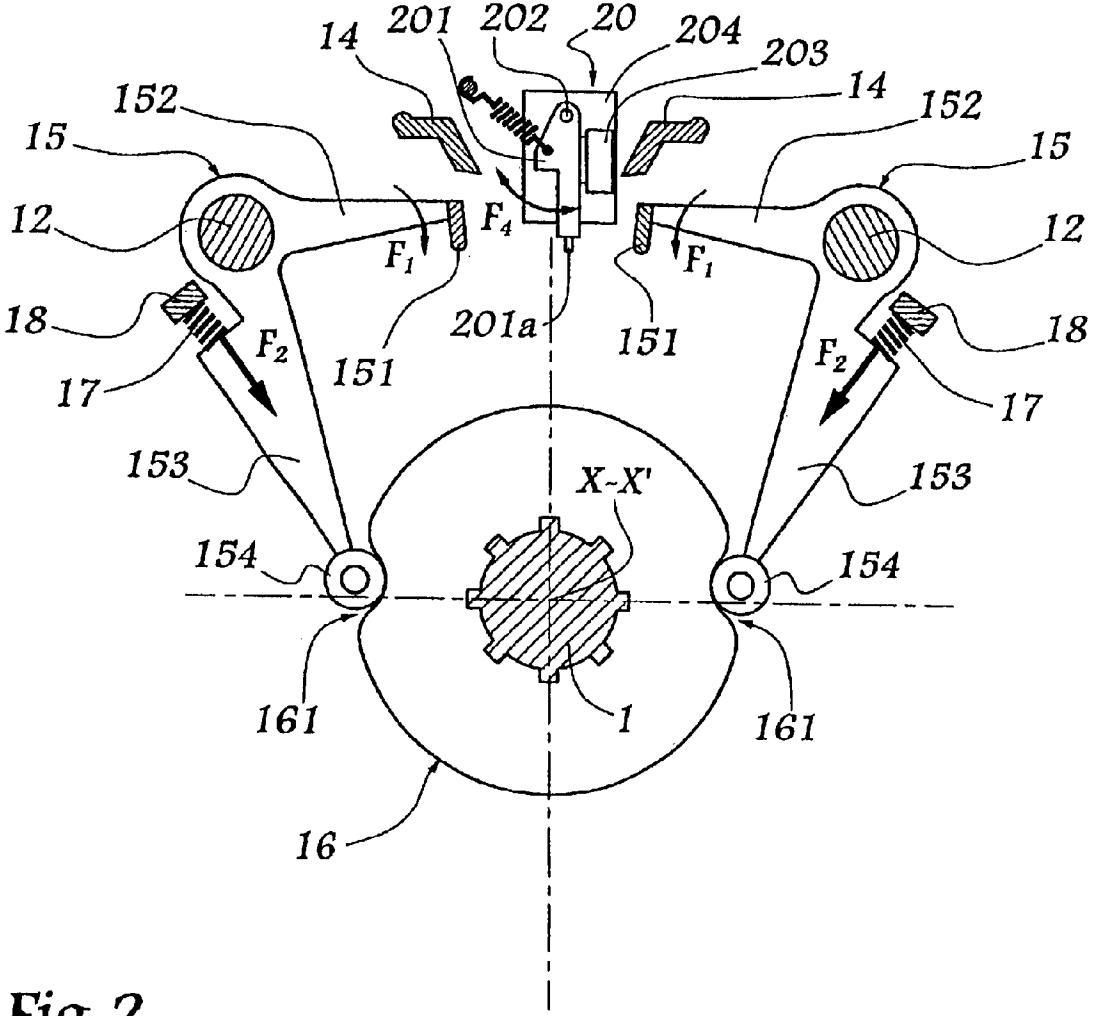
FIG. 2 is a cross section of the dobby of FIG. 1 in a plane parallel to that of FIG. 1.

Referring now to the drawings, the dobby shown in FIGS. 1 and 2 comprises a principal shaft 1 animated by an intermittent movement of rotation with stop at every half-revolution. This shaft 1 receives a series of roller bearings in a number equal to that of the heddle frames or of the blades of the loom. On each roller bearing is idly mounted an eccentric 2 extending laterally by a plate 3. On each eccentric 2 is idly mounted the opening of a connecting rod 4 of which the free end is connected to a pivoting arm 5 which, thanks to connecting rods 6*a* and levers 6*b* in bracket form, ensures the vertical displacement of the heddle frame 6 of the blade in question, shown very schematically.

Between two contiguous eccentrics 2, the shaft 1, provided to be splined, bears a drive disc 7 which is fast therewith and whose periphery has two radial notches 7*a*, diametrally opposite one another, cut out therein. These notches 7*a* are intended to selectively receive the terminal finger 8*a* of a pawl 8 articulated on a pin 9 borne by the lateral plate 3 of the corresponding eccentric 2. A spring 10 tends to return the finger 8*a* of the pawl 8 permanently in the direction of the shaft 1.

The control of each pawl 8 is ensured with the aid of two pivoting levers 11 pivotally borne on fixed pins 12 oriented parallel to the shaft 1. Each lever 11 presents a profile substantially in the form of a bracket, with two arms 111 and 112 oriented substantially at 90° with respect to one another.

At the end of its arm 112, each lever 11 presents a catch 113 capable of cooperating with a passive jamming surface 31 and an active jamming surface 32 made on the periphery of the plate 3. Thanks to the catches 113 and to the passive jamming surface 31 and active jamming surface 32, the plate 3 may be immobilized in two positions, separated by a rotation of the plate 3 through 180°, depending on whether the catch 113 shown to the left of FIG. 1 cooperates with the surface 31, while the catch 113 shown to the right cooperates with the surface 32, as shown in FIG. 1, or whether the catch 113 shown to the left cooperates with the surface 32 while the catch 113 shown to the right cooperates with surface 31.

In accordance with the invention, levers 15 are articulated about the pins 12 and are each provided with a cross-piece 151 arranged at the end of a first arm 152 of the levers 15. The cross-pieces 151 extend in a direction substantially parallel to the longitudinal axis X–X' of the shaft 1.

In the absence of action of the cross-pieces 151, i.e. when the cross-pieces 151 are in upper position, the springs 13 tend, whenever the jamming surfaces 31 and 32 of the plate 3 stop opposite the catches 113, to engage these catches in cooperation with the jamming surface 32 in the form of a notch, which has the simultaneous effect of angularly immobilizing the plate and, with it, the eccentric 2 and the connecting rod 4, and of controlling uncoupling of the pawl 8, i.e. withdrawing its finger 8*a* from the notch 7*a* in which it was introduced. This constitutes an "active" jamming of the plate 3 with respect to the lever 11.

Inversely, the jamming of the plate 3 by a lever 11, as results from the cooperation of elements 31 and 113, is "passive" in that it is elastic to the point of being overcome whenever the shaft 1 starts up.

Each lever 11 is urged by a draw spring 13 of which one end is fixed on a catching bar 14, the levers 11 tending, under the effect of the effort due to the springs 13, to move their respective catches 113 towards the shaft 1. Concerning the lever 11 located towards the pawl 8, the spring 13 tends to push the catch 113 towards the pawl 8 and thus to disengage the finger 8*a* from the nearest notch 7*a*.

Each lever 15 is also provided with a second arm 153 of which the free end bears a roller 154 intended to cooperate with a control cam 16 fixed on the shaft 1. The cam 16 is provided with two diametrally opposite notches 161 for engagement of the rollers 154.

During rotation of the cam 16 which is concomitant with the rotation of the shaft 1, the rollers 154 are ejected from the notches 161 and the levers 15 pivot in the direction of arrows $F_1$ in FIG. 2. This pivoting takes place against an elastic return effort $F_2$ exerted by return springs 17 in abutment on fixed stops 18.

In this way, the rotation of the shaft 1 has the effect of displacing the cross-pieces 151 in the direction of the arms 111 of the levers 11 and of pivoting the levers 11 which are not already in mesh with a surface 31, in the direction of arrow $F_3$ in FIG. 1.

It should be noted that the levers 11, of which the catches 113 are already in mesh with jamming surfaces 31, are out of range of a selector 201 belonging to the reading device 20 of the dobby, this in accordance with the technical teaching of FR-A-2 757 882. In addition, in this position, these levers are also out of range of the cross-pieces 151.

In this way, the cross-pieces 151 perform the role of pushers which, upon every half-revolution of the shaft 1 and simultaneously, push the arms 111 of the levers 11 and disengage them from the selectors 201.

It should be noted that the levers 15 are independent of the selector 201 to which they do not transmit stresses directly.

When an eccentric 2 is driven thanks to the pawl 8, the cross-pieces 151 exert an effort $F_5$ of displacement of the two associated levers 11, on their respective arms 111.

The reading device 20 is mounted between the catching bars 14 and comprises a selector 201 which is articulated about a fixed pin 202 and capable of a pivoting represented by the double arrow $F_4$ in FIG. 1. The pivoting of the selector 201 is controlled thanks to an electromagnet 203, fixedly mounted on a frame 204 from which the pin 202 extends, and to a return spring 205.

Taking into account the function of the cross-pieces 151, the selector 201 may be displaced by the electromagnet 203 when the cross-pieces 151 exert an effort $F_5$ of thrust on the arms 111 in the direction of the shaft 1, this effort resulting in the pivoting of the levers 11 in the direction of arrows $F_3$ and having the consequence of moving the catches 113 away from the jamming surfaces 32. In this configuration shown in FIG. 1, the selector 201 may be tipped, as represented by arrow $F_4$, between a position of blocking of the lever 11 of which the catch 113 is opposite the pawl 8 and a neutral position opposite the arm 111 of the other lever which is out of range of the selector 201, being tipped under the effect of the abutmen of its catch 113 on the surface 31.

Depending on which lever 11 is in abutment on the surface 31, the single end 201*a* of the selector 201 may block one or the other of the levers 11.

In this way, the essential of the mechanical efforts controlling the movement of the levers 11 is exerted by levers 15 and, more specifically, by the cross-pieces 151, while the selector 201 simply opposes the pivoting of one or the other of the levers 11 under the effect of the springs 13.

It will be noted that the movement of these cross-pieces is the same for all the blades of the dobby, with the result that these cross-pieces may extend over substantially the whole width of the dobby, i.e. the length of the shaft 1, being articulated on the fixed pins 12, preferably at each end of the cross-pieces 151.

Bearing the foregoing in mind, the cross-pieces 151 perform a function of levelling of the levers 11 of the dobby which they traverse simultaneously for all the blades.

Figure 3:
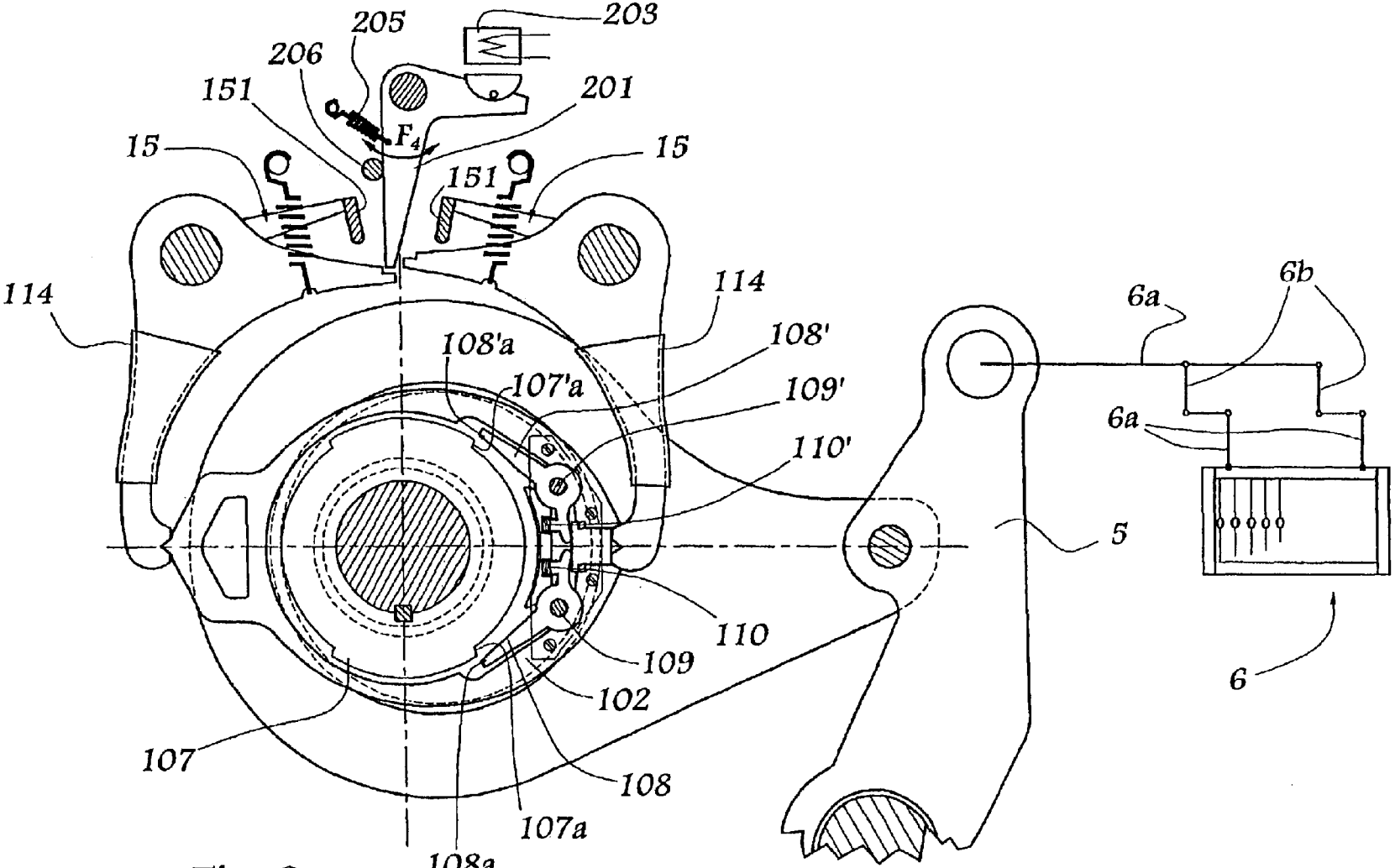
FIG. 3 is a view similar to FIG. 1 for a dobby in accordance with a second form of embodiment of the invention.

In the second form of embodiment of the invention shown in FIG. 3, elements similar to those of the first embodiment bear identical references. This embodiment differs from the preceding one in that the locking member is not a pawl but a pair of locks 108 and 108' articulated on pins 109*a* and 109'*a* fast with the plate 3 and comprising arms forming heel 108*a*, 108'*a*, respectively, adapted to interact with notches 107*a* and 107'*a* provided on a disc 107 of the same type as the disc 7 of the first embodiment. The locks 108 and 108' are each subjected to the action of a spring 110, 110', respectively. As previously, these locks 108 and 108' are controlled by levers 11 subjected to the action of cross-pieces 151 belonging to levers 15 similar to those of the first embodiment.

The selector 201 is subjected to the action of a spring 205 and of an electromagnet 203 and its movement $F_4$ is limited by a stop 206.

Advantageously, at least certain of the arms 112 of the levers 11 are each surrounded by a sleeve 114 made of synthetic material, of which the material is chosen in order to limit the frictions with respect to the surrounding elements of the dobby, such as the connecting rods 4 or the eccentrics 2, with which they present a reduced clearance. These sleeves also allow a very precise positioning of the levers between the blades and avoid the use of additional pieces such as guiding rakes. This makes it possible to improve the life duration of the levers 11 and of the adjacent elements. The sleeves 114 may be made of polyamide or polyacetal, possibly reinforced.

In the representation of FIG. 1, the cross-pieces 151 are in lower position where they exert on the right-hand lever 11 an effort $F_5$ of thrust. In FIG. 3, the cross-pieces of the second embodiment are in upper position and do not interfere with the levers.

According to a variant of the invention (not shown), the locks 108 and 108' may also be in accordance with the technical teaching of FR-A-2 802 218.

According to another variant likewise not shown, the control of the levers 15 may be positive, for example by means of positive-drive cams, which makes it possible to envisage the elimination of the springs 17.

The technical characteristics of the different forms of embodiment envisaged may be combined together and still remain within the framework of the present invention.

What is claimed is:

1. Rotating dobby for weaving loom which comprises, at the level of each of its blades:

an oscillating piece connected to a heddle frame and associated with an actuation element mounted idly on a principal shaft of this dobby, a mobile coupling member borne by the actuation element, this mobile member being subjected to first elastic means in order to effect the angular link of the actuation element with a disc fastened with the principal shaft, and the control of said mobile coupling member being ensured with the aid of two pivoting levers substantially in the form of a bracket subjected, on the one hand, to the action of a reading device and, on the other hand, to that of second elastic means which tend to engage the catch of each pivoting lever either with a jamming surface provided opposite the mobile coupling member on the actuation element or with said mobile coupling member, in which case said mobile coupling member is controlled for uncoupling of said actuation element with respect to said disc, while, when a lever is in engagement with said jamming surface, it is out of range of a selector belonging to said reading device, said selector being provided with an end adapted alternately to block the pivoting of one or the other of said levers in bracket form, wherein it further comprises mechanical members adapted to displace at least one lever, of which the catch is not in engagement with said jamming surface, against the action of said second elastic means, with the result that said lever does not interfere with the angular displacement of the said selector.

2. The dobby of claim 1, wherein said mechanical members are adapted to interact simultaneously with all the levers of all the blades of the dobby which are not already in engagement with a jamming surface.

3. The dobby of claim 1, wherein said mechanical members comprise cross-pieces extending in directions substantially parallel to the longitudinal axis of said principal shaft.

4. The dobby of claim 1, wherein said mobile coupling member is a pawl articulated on a pin borne by said actuation element.

5. The dobby of claim 1, wherein said mobile coupling member is constituted by a pair of locks, controlled and articulated on said actuation element.

6. The dobby of claim 1, wherein said selector is pivoting, controlled by an electromagnet against the action of elastic return means and adapted to maintain one or the other of said levers in a position where its catch is spaced apart from said coupling member.

7. The dobby of claim 1, wherein said mechanical members are articulated on pins merged with the respective pivot axes of said levers.

8. The dobby of claim 1, wherein said mechanical members are controlled by at least one cam driven by said principal shaft, said mechanical members being subjected to the action of elastic means for return towards a position disengaged with respect to said levers.

9. The dobby of claim 1, wherein at least one of said levers is surrounded by a sleeve made of synthetic material compatible with the slide of said lever with respect to the adjacent elements, said sleeve presenting a reduced clearance with respect to said adjacent elements.

10. Weaving loom equipped with a dobby according to claim 1.

* * * * *